United States Patent [19]

Ratanangsu

[11] 4,370,817

[45] Feb. 1, 1983

[54] ELEVATING BOOT

[76] Inventor: Karl S. Ratanangsu, 7752 Bellaire Ave., North Hollywood, Calif. 91605

[21] Appl. No.: 234,308

[22] Filed: Feb. 13, 1981

[51] Int. Cl.[3] ..... A43B 7/16
[52] U.S. Cl. ..... 36/81
[58] Field of Search ..... 36/81, 88, 91, 93

[56] References Cited

U.S. PATENT DOCUMENTS 2,700,230 1/1955 Beyer ..... 36/81
4,265,033 5/1981 Pols ..... 36/81

FOREIGN PATENT DOCUMENTS 539024 2/1956 Italy ..... 36/81

*Primary Examiner*—Patrick D. Lawson
*Attorney, Agent, or Firm*—Jack C. Munro

[57] ABSTRACT

An elevating boot wherein the heel section of the boot includes a height increasing insert for the wearer located within the boot in the area of the heel. This insert is to be removable, or it can be integrally secured to the boot. The forwardmost section of the boot includes a significant amount of space so as to make the size of the boot larger so as to be in proportion to the appearance of the increased height of the wearer. Within the space is to be located a second insert. A connecting section connects said first and second inserts.

3 Claims, 4 Drawing Figures

ELEVATING BOOT

BACKGROUND OF THE INVENTION

The field of this invention relates to shoes which are to be worn by human beings, and more specifically to a foot covering which deceptively gives the appearance that the wearer is substantially taller.

It has been common for human beings, when wanting to appear taller, to wear shoes that elevate the individual to a greater height. Normally, such types of shoes incorporate an increased height heel section (and possibly a sole section) so to raise the individual's height.

The main disadvantage of such prior elevating type foot coverings is that the use of such an elevating shoe is readily obvious. Therefore, to another individual only a glance is required to ascertain that the individual is wearing elevating shoes, and is therefore substantially shorter than his actual appearance.

It would be desirable to design some type of an elevating foot covering wherein the fact that one was wearing an elevating shoe could not be easily ascertained, thereby not making it readily apparent that the individual is substantially shorter.

SUMMARY OF THE INVENTION

The structure of this invention relates to the incroporating of a boot, as opposed to a shoe, wherein the boot has a sole to which there is attached a conventional heel, a covering located about the upper surface of the sole to encase the wearer's foot, and an upwardly extending ankle tubular extension integrally secured to the covering. An insert is to be located within the boot in the area of the heel section and the wearer's heel is to be positioned on top of the insert. The height of the insert will normally be equal to, if not greater than, the height of the heel. The insert is to have an inclined surface which connects to a thin forward layer located in the area of the ball of the foot. The forwardmost end of the shoe is extended with a second insert located within the additional space. This is to make it appear that the size of the foot is larger so as to be in proportion to the appearance of the increased height of the wearer. The wearer's ankle is to abut against the inside surface of the tubular extension to keep the wearer's foot from sliding forward plus the second insert functions also to prevent forward sliding movement.

DEAILED DESCRIPTION OF THE SHOWN EMBODIMENT

Figure 1:
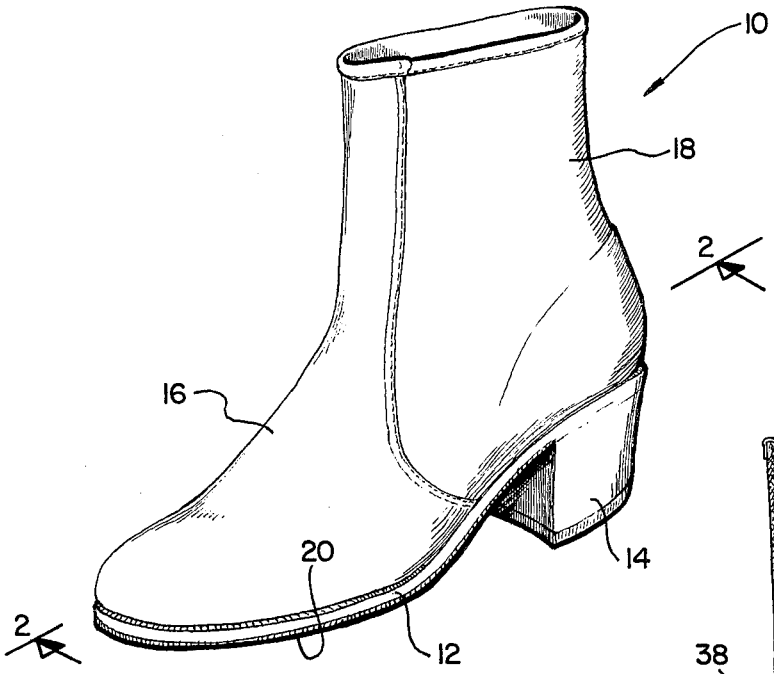
FIG. 1 is an exterior perspective view of the elevating boot constructed in accordance with this invention.
Figure 2:
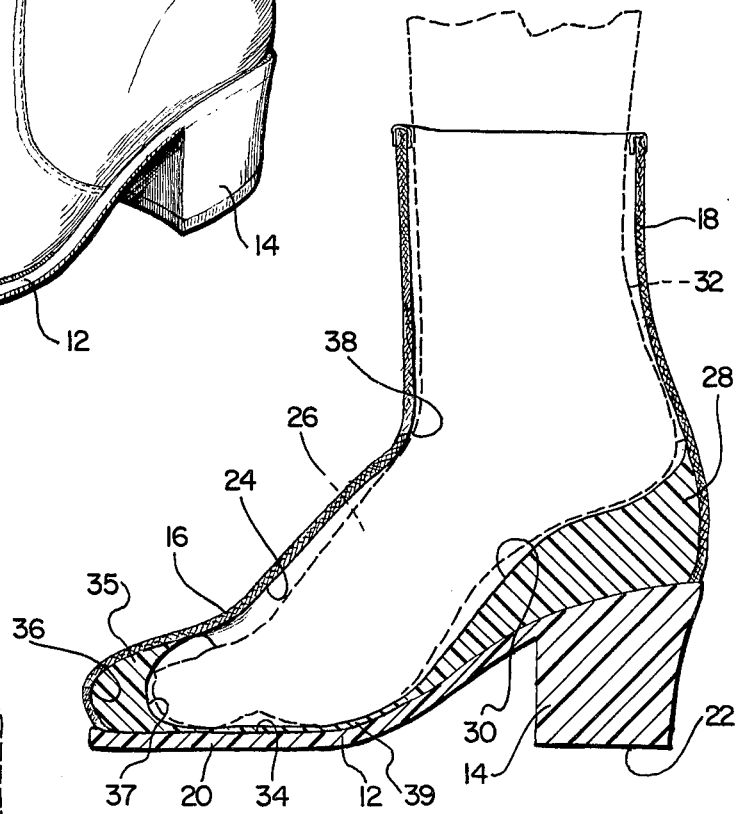
FIG. 2 is a cross-sectional view taken along line 2–2 of FIG. 1.

Referring particulary to the drawing, there is shown the boot 10 of this invention which is constructed generally of a sole 12, a heel 14, a foot covering 16 and an ankle covering 18.

The sole 12 will normally be constructed of leather or other similar type of material and at its front end thereof has a flat planar surface 20. The heel 14 is secured to the aft end of the sole 12 and includes a planar bottom surface 22. It is to be noted that the planar bottom surfaces 20 and 22 lie on the same plane.

The covering 16 will normally comprise leather or other similar type of sheet material covering. The tubular extension 18 is to be located about the ankle of the wearer and will normally comprise material identical to the covering 16. The covering 16 forms an enclosing chamber 24 within which is to be located the wearer's foot 26.

Within the enclosing chamber 24 there is to be located an insert 28. This insert is to be formed of leather, plastic or other rigid material and has an upper inclined surface 30. The heel 32 of the wearer's foot is to be positioned against the aft end of the insert 28 which is located directly above the heel 14. The inclined surface 30 eventually becomes quite thin and is integral with section 39. Section 39 is located on top surface 34 of the sole 12. Section 39 is integrally connected with forward insert 35. Forward insert 35 is located within the toe portion of the enclosing chamber 24. Section 39 has an inner toe locating chamber 37. The inserts 28 and 35 and section 39 are to be secured by adhesive or other conventional fastening means to the upper surface 34 of the sole 12.

In actual practice, using the structure of this invention, the individual will appear to have a height increase of approximately ten centimeters. This is a significant increase and a person of this increased height will normally have a larger foot. To give the appearance of an increased size of foot, there is formed within the fore end of the enclosing chamber 24 an empty space 36. This empty space will normally be at least two and a half to three centimeters in length. Therefore, this will give the appearance of the wearer having a larger foot which is in proportion to the increased height. The second insert 35 is located within the space 36.

In order to keep the wearer's foot 26 from sliding forward toward the space 36, the wearer's ankle is to be in snug contact with contact point 38 of the tubular extension 18. Also, the insert 35 prevents forward movement of the foot. It is to be noted that it is necessary to employ the structure of this invention in conjunction with a boot so as to conceal the use of the insert 28 and so as to hold the wearer's foot 26 in position and keep it from sliding forward.

Figure 3:
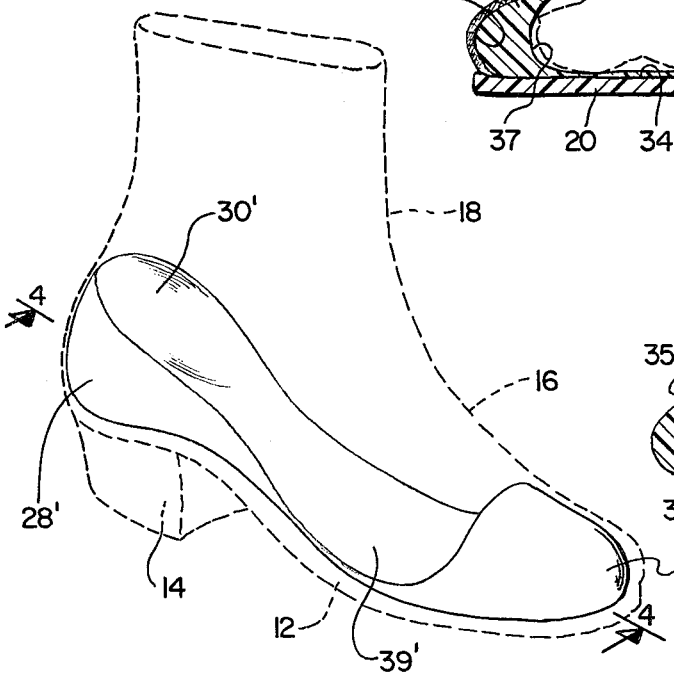
FIG. 3 is an isometric view of an interior of a modified form of boot constructed in accordance with this invention.
Figure 4:
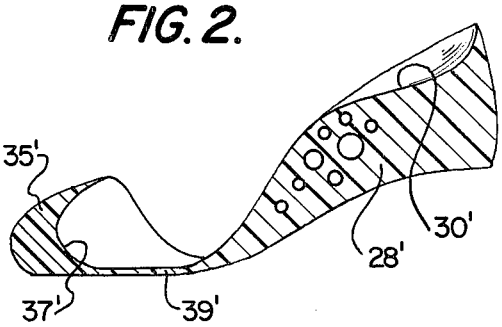
FIG. 4 is a cross-sectional view taken along line 4–4 of FIG. 3.

Referring particularly to FIGS. 3 and 4 of the drawing, there is shown a modified form of insert 28' which has an upper inclined surface 30'. The insert 28'is basically identical to the insert 28 except that it is removable within the boot 10.

It is to be noted that normal desirable material of construction for the inserts 28 and 28' could be cork, plastic, wood, or the like.

What is claimed is:

1. An elevating boot comprising:

a sole having a fore end and an aft end and a top surface and a first bottom surface;

a heel secured to said first bottom surface of said sole at said aft end, said heel having a second bottom surface, said first and second bottom surfaces to be substantially on the same plane;

a covering attached to said sole encasing said top surface of said sole, said covering being adapted to enclose the wearer's foot forming an enclosing chamber when positioned against said top surface of said sole;

a tubualr extension attached to said covering, said tubular extension being open ended and adapted to be located about the ankle of the wearer, the forward most section of said tubular extension to be in tight contact with the ankle of the wearer to prevent forward motion of the wearer's foot during walking;

a first insert mounted on said aft end of said sole and encased by said covering, said first insert having an upper inclining surface, said upper inclining surface to extend from directly adjacent said top surface of said sole to a spaced distance above said top surface at said aft end;

said enclosing chamber at said fore end including a second insert which is to be located forward of the wearer's foot, said second insert makes it appear that the size of the foot is larger to be in proportion to the appearance of the appearance of the increased height of the wearer due to the combination of the height of the heel and said first insert; and a connecting section connected between said first and second inserts.

2. The elevating boot as defined in claim 1 wherein:

said first and second inserts to be removably mounted on said sole.

3. The elevating boot as defined in claim 1 wherein:

said first and second inserts being integrally attached to said sole.

* * * * *